United States Patent [19]

Lewis

[11] 4,391,208

[45] Jul. 5, 1983

[54] METHOD FOR CONTROLLING TEMPERATURES IN THE AFTERBURNER AND COMBUSTION HEARTHS OF A MULTIPLE HEARTH FURNACE

[75] Inventor: Frederick M. Lewis, Mountain View, Calif.

[73] Assignee: Sterling Drug, Inc., New York, N.Y.

[21] Appl. No.: 192,021

[22] Filed: Sep. 29, 1980

[51] Int. Cl.[3] ..... F23G 5/04

[52] U.S. Cl. ..... 110/346; 110/225; 110/244; 432/139

[58] Field of Search ..... 110/243, 244, 208, 209, 110/225, 346; 432/139, 151

[56] References Cited

U.S. PATENT DOCUMENTS

| | | | |
|---|---|---|---|
| 3,536,018 | 10/1970 | Phelps | 110/244 |
| 3,777,680 | 12/1973 | Eck | 110/225 |
| 3,962,128 | 6/1976 | Nelson et al. | 432/139 |
| 4,013,023 | 3/1977 | Lombana et al. | 110/225 |
| 4,046,085 | 9/1977 | Barry et al. | 432/139 |
| 4,046,086 | 9/1977 | von Dreusche, Jr. | 432/139 |
| 4,050,389 | 9/1977 | von Dreusche, Jr. | 110/225 |
| 4,182,246 | 1/1980 | Lombana et al. | 110/188 |
| 4,227,873 | 10/1980 | Manshansen et al. | 432/139 |

*Primary Examiner*—Henry C. Yuen

*Attorney, Agent, or Firm*—Wenderoth, Lind & Ponack

[57] ABSTRACT

The present invention relates to a method for efficiently incinerating waste material, particularly dewatered sludge, in a multiple hearth furnace by controlling the temperature of the individual hearths of the furnace within certain prescribed limits by modulating the amount of combustion air, and controlling the temperature of the afterburner or combustion hearths to within certain prescribed limits by splitting the feed sludge between the first two upper waste material handling hearths.

23 Claims, 6 Drawing Figures

METHOD FOR CONTROLLING TEMPERATURES IN THE AFTERBURNER AND COMBUSTION HEARTHS OF A MULTIPLE HEARTH FURNACE

BACKGROUND OF THE INVENTION

1. Field of the Invention

This invention relates to a method of incinerating waste material in a multiple hearth furnace, and to a multiple hearth furnace for carrying out this method. More particularly, the invention relates to a system for controlling the temperatures in the combustion hearth(s) of a multiple hearth furnace, while at the same time controlling the temperature of the afterburner to a nominal temperature to avoid pollution of the atmosphere by the gases exhausted from said afterburner.

2. Description of the Prior Art

Waste materials and particularly sewage sludge, have heretofore been incinerated in multiple hearth furnaces. In the early use of such furnaces, the waste material was simply fed to the uppermost hearth, and air was supplied to the lowermost hearth, and fuel burners were placed on the various hearths as needed for ensuring that combustion took place. The furnace operated to dry the sludge in the uppermost or the next to uppermost hearth, and the thus-dried sludge was passed from hearth to hearth and gradually completely incinerated, the ash being discharged from the lowermost hearth.

In a typical multiple hearth furnace for treating sludge, the furnace is divided into three distinct operating zones:

(1) an upper drying zone defined by a drying hearth in which a major portion of the free water contained in the sludge is evaporated;

(2) an intermediate combustion zone defined by at least one hearth in which the combustible material contained in the sludge is combusted; and (3) a lower cooling zone defined by a bottom hearth in which the inert solid residue remaining from the combustion process in the combustion zone is cooled by air.

In such a furnace, the solid sludge is introduced into the top of the furnace and descends from one zone into another until it reaches the lowest zone where it is ultimately discharged from a hearth known as the "ash cooling" hearth. Meanwhile, gases from the combustion zones, etc., flow upwards, countercurrent to the downward flow of the solid materials and which gases are treated to remove the malodorous gases and pollutants in an afterburner either located above the hearth defining the drying zone or separate from the main furnace. However, no precise methods have been yet devised to carefully control the temperatures of the individual combustion hearths within carefully controlled limits to prevent, e.g., run away temperatures, and to operate the afterburner within certain limits prescribed by environmental law without the need of adding auxiliary fuel to the afterburner. In respect to the latter point, when the sludge introduced into the drying hearth contains excess water and the combustion gases passing upward over the wet sludge are cooled below the prescribed temperature limits, the gases must ordinarily be further heated in the afterburner by auxiliary fuel to reach the temperature required to comply with environmental laws.

In view of the above, the methods and designs of multiple hearth furnaces used to incinerate sludge have been inefficient in one or more of the above drawbacks previously mentioned.

Recently, there have been attempts made to improve the efficiency of combustion and the design of multiple hearth furnaces. For example, in U.S. Pat. Nos. 4,013,023 and 4,182,246 to Lombana et al., the temperatures in several of the lower hearths have been monitored and the supply of air and fuel to these hearths controlled so as to pyrolyze the materials. By pyrolizing the materials is meant that the waste material is heated in an oxygen deficient atmosphere, i.e., in amounts less than the amount needed to support complete combustion and such operation is carried out in what is called the "pyrolysis mode". In the afterburner, air is introduced to complete the oxidation of the partially oxidized substances which are present in the gases and vapors from the furnace. The air supply to the afterburner is controlled so that at temperatures above a predetermined temperature, the quantity of air introduced is increased with increasing temperatures and is decreased with decreasing temperatures. In other words, the pyrolyzing furnace is caused to operate with a deficiency of air over its operating range, while the afterburner is caused to operate with excess air and the amount of excess air supplied is used to control the operating temperature by cooling or quenching the gases in the afterburner according to these prior art methods.

In U.S. Pat. Nos. 4,046,085 and 4,050,389, a multiple hearth furnace is operated by separately supplying air to the respective hearths to add an oxidant including water vapor, to the fixed carbon zone; or by controlling the amount of air supplied to the respective hearths in response to the temperature on the respective hearths and the temperature of the next higher hearth.

U.S. Pat. No. 3,958,920 shows a multiple hearth furnace in which relatively low temperature gases from the drying zone are recycled to the combustion zone to absorb excess heat. The method of this patent is known as the "Anderson Recycle" and functions by recycling 800° F. moisture-laden gases from the drying hearth back to the combustion hearth to control the temperature. The fan used to recirculate such gases, however, has to handle 800° F. gases with entrained particulate material which is a very severe service. There is also additional electric power required to operate this system.

In all of these recently developed methods of operating a multiple hearth furnace, the purpose has been to control the burning more closely than in the earlier multiple hearth furnaces in order to achieve better incineration of the waste materials.

In such furnaces, however, when sludge is the waste material, it is normally introduced in a form in which it contains an amount of water such that the sludge will not immediately burn. Thus, the sludge is introduced to the upper hearth of the multiple hearth furnace where it is dried by the countercurrent flow of hot flue gases from the combustion hearths below to a sufficiently dry state where it can be burned.

Recent methods have been developed for converting non-autogenous sludge to so-called "autogenous" sludge by a thermal conditioning process. This pretreatment step enables a sufficient quantity of the water to be removed so that the sludge can be supplied to a multiple hearth furnace and incinerated in such a way as to obtain an excess of heat which then can be used for generating steam or the like. Thermally conditioned and dewatered sludge is characterized by low moisture content, high volatile content, and high heating or calorific value; this is as compared to non-autogenous sludge, which has a high moisture content, low volatile content and low heating value. An example of the latter sludge is known as "chemically conditioned sludge".

The introduction of autogenous sludge, such as thermally conditioned sludge, has facilitated the incineration process, making it possible to incinerate the waste material with a minimum of auxiliary fuel needed. Further, combustion with thermally conditioned sludge greatly enhances the energy recovery and steam potential is substantially increased. Improved energy recovery will become increasingly important as energy costs continue to escalate.

While the introduction of such autogenous fuel has been a great boon to the industry, however, it is fraught with certain disadvantages. One of the key disadvantages is that in the combustion of autogenous sludge, it is difficult to control the temperature of the individual combustion hearths within safe operating temperatures because of the high calorific value of such sludge. To counteract this, various methods have been employed to cool down the combustion hearths to avoid thermal stress on the furnace equipment, but most of these methods are largely inefficient. At the same time, because the feed is introduced into the upper drying hearth, it has not been possible to control the temperature of the afterburner to within prescribed environmental conditions without the addition of auxiliary fuel.

The present invention aims at overcoming the disadvantages of the prior art.

OBJECTS OF THE INVENTION

It is an object of the present invention to provide a method for incineration of sludge in a multiple hearth furnace in a more efficient manner.

It is another object of the present invention to provide a method for incinerating sludge, particularly autogenous sludge, in such a manner that the temperatures of the individual hearths of the furnace are directly controlled in response to the true thermal conditions within the individual hearths.

It is still a further object of the present invention to provide a means of supplying air to the individual hearths of a multiple hearth furnace for controlling the temperature in the individual hearths in response to the temperature conditions of such individual hearths.

It is a further object to provide efficient air supply means for supplying air to the individual hearths of a multiple hearth furnace for carrying out this method.

It is still another object of the present invention to provide a method for controlling the temperature of the afterburner, which can be the uppermost hearth, sometimes called the "O hearth", of a multiple hearth furnace, or which can be a separate chamber, limiting the temperature drop which ordinarily occurs when the combustion gases pass over the uppermost sludge handling hearth. The temperature drops as a result of the evaporation of water from the wet sludge in said sludge handling hearth.

It is still a further object of the present invention to provide a means for controlling the temperature of the afterburner, by splitting the feed of the sludge between the uppermost sludge handling hearth and the hearth directly therebelow in such amounts as to control the temperature of the afterburner, thereby obviating the need for supplying auxiliary fuel to said afterburner.

Finally, it is an object of the present invention to provide a method of burning auxiliary fuel in one or more of the hearths below the lowermost hearth onto which the sludge is fed in response to the temperature in the afterburner for controlling the temperature in the afterburner, and to provide means in association with a multiple hearth furnace for carrying out this method.

BRIEF DESCRIPTION OF THE DRAWINGS

These and other objects of the invention will become apparent from the following specification, taken together with the accompanying drawings, in which.

SUMMARY OF THE INVENTION

Figure 1:
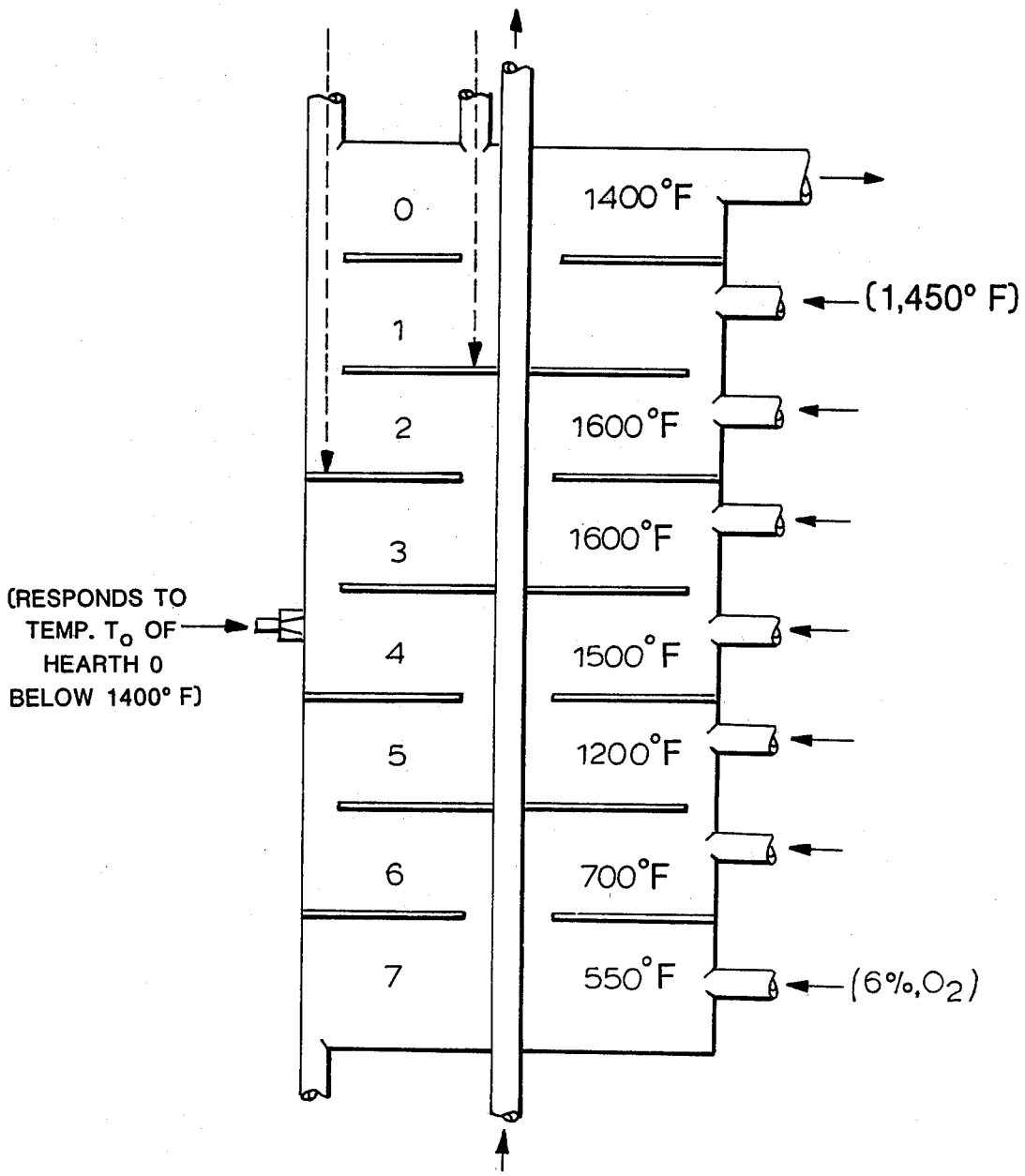
FIG. 1 is a schematic cross-section of a multiple hearth furnace illustrating the method of carrying out the present invention.
Figure 2:
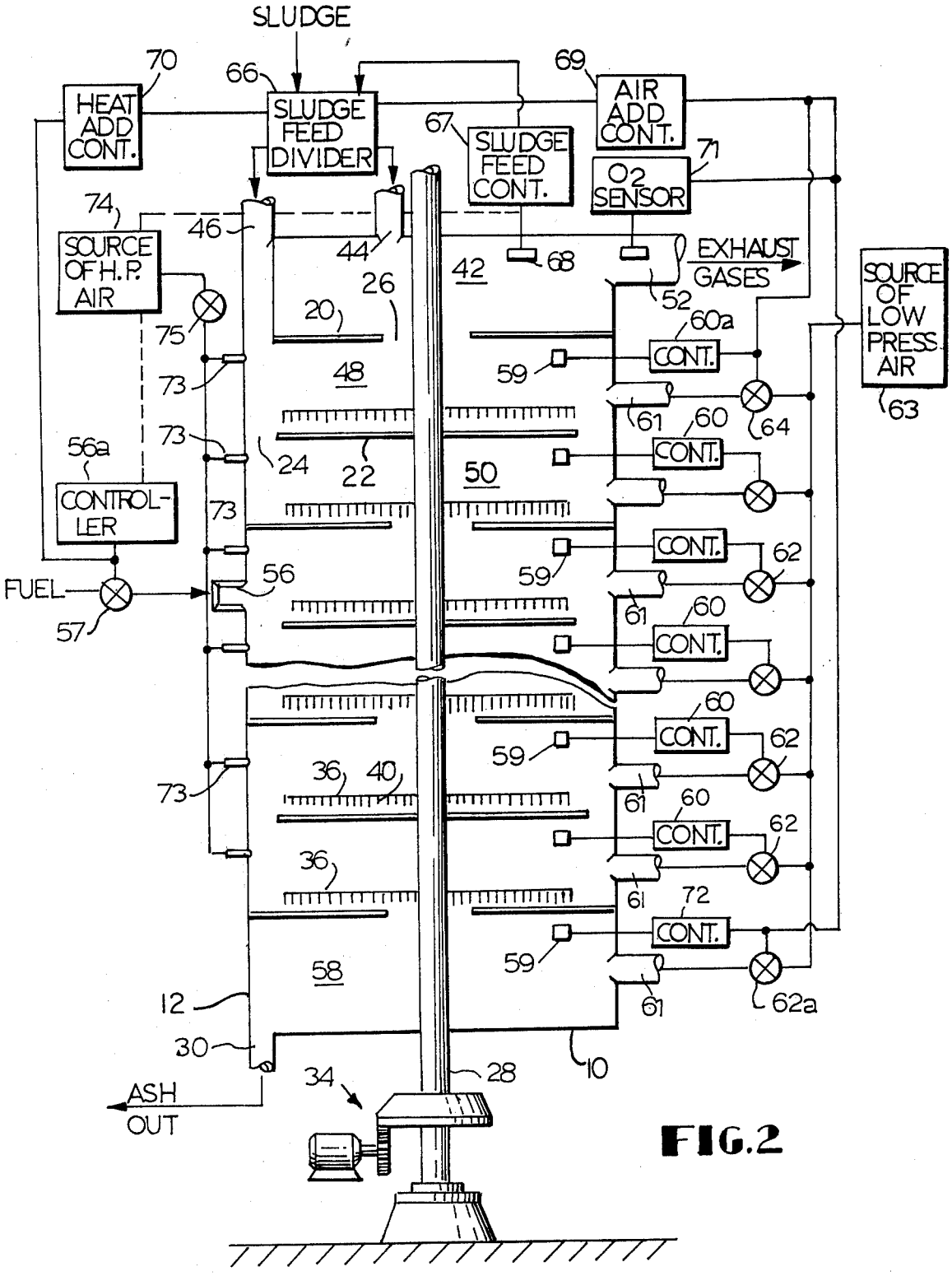
FIG. 2 is a schematic elevation view of a multiple hearth furnace according to the present invention.

The present invention relates to the incineration of a waste material, particularly an autogenous waste material, such as thermally conditioned, dewatered sewage sludge, in a multiple hearth furnace. While the invention in one variation thereof also contemplates the combustion of non-autogenous sludge, or sludge of a high moisture content and a low calorific value, the principle mode of the present process will be illustrated in respect to the incineration of autogenous waste material. The design of the apparatus as illustrated in FIGS. 1 and 2 is also capable of incinerating a great variety of sludges varying between autogenous and non-autogenous sludge as will be apparent by an understanding of the capabilities of Applicant's method and furnace design from the following description.

As pointed out previously, the incoming sludge in a conventional multiple hearth furnace is fed into an uppermost sludge handling hearth for the purpose of drying the incoming wet sludge so that it can be incinerated in the combustion hearths below the drying hearths. On the other hand, the combustion gases pass countercurrent to the downward flow of the waste material, pass over the wet sludge in the uppermost sludge handling hearth, known in the prior art as the "drying hearth" and the gases are cooled because of the moisture evaporation and the temperature is considerably lowered before it reaches the "O" hearth afterburner, typically located just above the drying hearth. Thus, when an autogenous waste material, for example, such as thermally conditioned, dewatered sewage sludge is incinerated in a multiple hearth furnace, the temperature of the intermediate combustion hearth(s) is always higher than that of the "O" hearth afterburner (hereinafter simply called the "afterburner"). This is because the hot flue gases from the combustion hearth(s) pass countercurrently over the incoming wet sludge in the drying hearth and the moisture evaporated cools the flue gases. In multiple hearth furnaces of conventional design there is typically a temperature difference of approximately 600° F. between the gases in the combustion hearth and the gases in the afterburner.

To comply with stringent environmental regulations and to maximize energy recovery, it is necessary to operate the afterburner hearth at a nominal temperature of around 1400° F. With conventional designs this would then require about 2000° F. (1400° F.+600° F.) in the combustion hearth to compensate for the temperature loss as a result of the flue gases being cooled in the drying hearth. However, because of the problems of thermal stress on the materials of construction and the possibility of fusion of the ash, combustion hearth temperatures are typically limited to 1600° F. maximum. Thus, even when sludge has a low moisture content and high calorific value so as theoretically to be autogenous at 1400° F., conventional incinerators require auxiliary fuel in the afterburner whenever temperatures over 1000° F. (1600° F.–600° F.) are desired.

The present invention provides a method for autogenous incineration of sludge, whereby the temperatures of the combustion hearth(s) can be controlled within safe limits (1600° F.) while still maintaining the "O" hearth afterburner at a high enough temperature to ensure compliance with environmental regulations (1400° F.), without the need of using auxiliary fuel in the afterburner.

As an additional benefit, an incinerator operating autogenously with a 1400° F. outlet temperature will produce approximately 25% more steam in the waste heat boiler than an incinerator, burning the same sludge autogenously, but with a 1000° F. outlet temperature.

For the successful autogenous incineration of a waste material (such as thermally conditioned sewage sludge) in a multiple hearth furnace, it is necessary to simultaneously achieve two (2) primary goals:

1. Maintain the "O" hearth afterburner at a nominal temperature of at least about 1400° F. without the need of adding auxiliary fuel.
2. Maintain the maximum temperature of the hearth(s) at a nominal temperature of about 1600° F.

In order to achieve these objectives, Applicant has discovered that the temperature in the afterburner can be controlled within the above prescribed limits in the following manner:

A. The afterburner temperature is controlled by splitting the feed sludge between the uppermost sludge handling hearth (normally known as the drying hearth) and the combustion hearth directly below said uppermost sludge handling hearth.

B. The maximum hearth temperature of the individual hearths are controlled by varying the quantity of sludge combustion air to the respective hearths.

In respect to point B above, it must be pointed out that the operation of Applicant's method is in what is known as the "incineration mode", rather than the "pyrolysis mode" of operation. In the incineration mode, sufficient oxygen is supplied to the combustion hearth(s) to support complete combustion and this amount of air is ordinarily above the stoichiometric amount of air needed and usually exceeds the stoichiometric amount by about 75%. This, of course, can vary depending upon the nature of the sludge and the particular means of supplying air according to the present invention as will be subsequently described. This is in contrast to the pyrolysis mode of operation where the combustion hearth(s) operate under a "starved air" condition and the combustion is completed by adding excess air in the afterburner as described in the aforementioned U.S. Pat. Nos. 4,013,023 and 4,182,246. Thus, in B above, when it is said that the control of the maximum hearth temperature is effected by varying the quantity of sludge combustion air, this usually means that the air is increased to an amount greater than that required for combustion in certain instances to achieve a cooling effect; in some cases it may be decreased as long as the total amount of air in the combustion hearths is ultimately enough to support combustion as will be discussed later on.

Now the method of the present invention will be described in respect to FIG. 1 of the drawings.

FIG. 1 is a schematic cross-section of a multiple hearth furnace employed in carrying out the method of the present invention. For clarity the nominal operating and control temperatures are shown on the various hearths. The temperatures indicated in parenthesis outside the body of the furnace are override controls which are not operating during normal autogenous operation. These override controls will be described later.

It must be emphasized that FIG. 1 is a mere skeletal structure of a multiple hearth furnace and this Figure is employed simply to highlight Applicant's invention to make for a better understanding of the mode of operation of the present invention. A practical embodiment of the present invention will be subsequently described in respect to the more detailed description of the multiple hearth furnace as shown in FIG. 2 of the drawings.

Referring to FIG. 1, the individual air supplies to hearths No. 2 through No. 7 are controlled by the temperatures of the respective hearths with the air supply increasing as the hearth temperatures go above a set point. This set of controls accomplishes the goal of limiting the maximum temperature of the respective combustion hearths to about 1600° F. or lower if desired. The temperature of hearth No. 0 (afterburner) is controlled by varying the feed split between hearths No. 1 and No. 2. If the temperature of hearth No. 0 goes above a set point (1400° F.), a greater percentage of the sludge is deposited onto hearth No. 1. With more sludge, more water is evaporated on that hearth, which will cool the 1600° F. gases coming up from the hearth No. 2 back down to 1400° F. Conversely, if the temperature on hearth No. 0 goes below the set point, a lesser percentage of sludge is deposited onto hearth No. 1. This set of controls accomplishes the goal of maintaining the afterburner temperature.

It should be noted that with the above control philosophy, the temperature of hearth No. 1 is not explicitly controlled. However, there is nothing on hearth No. 0 which is adding heat, and the only thing which subtracts heat is a small heat loss through the outside walls of hearth No. 0, and therefore when afterburner hearth No. 0 is controlled to 1400° F., hearth No. 1 is implicitly controlled to some temperature only slightly higher (1450° F. is typical).

Figure 5:
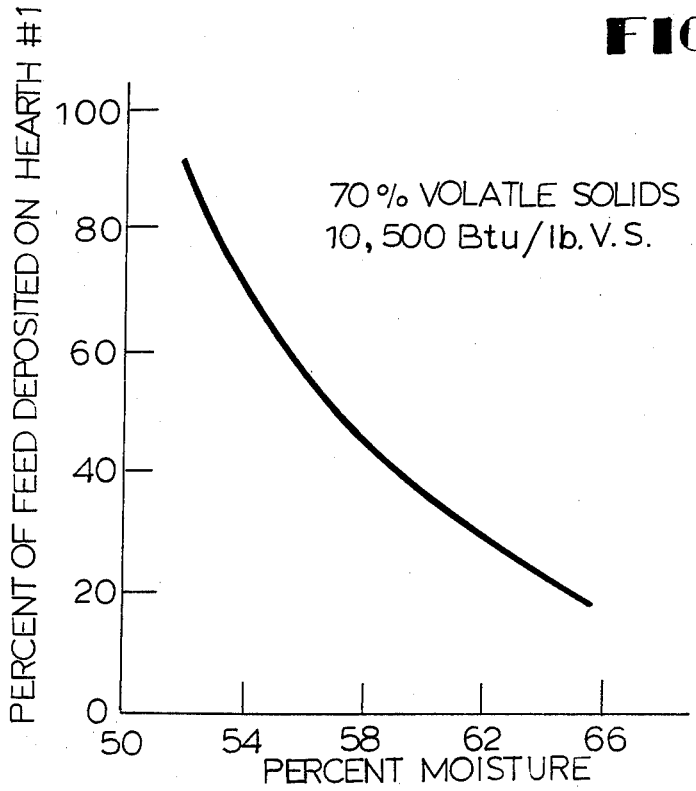
FIG. 5 is a graph showing the percent of waste material deposited on the uppermost sludge handling hearth of the apparatus of FIG. 2 in relation to the percentage of moisture in the waste material.

For illustrative purposes attention is directed to FIG. 5, which is a graph of the percent of feed deposited on hearth No. 1 vs. the percent of moisture for a typical thermally conditioned sludge. These calculations have been made assuming that burning begins when the sludge reaches 35% moisture and therefore any sludge deposited onto hearth No. 1 is dried to that value. Any further drying would cause ignition, which would cause a rise in temperature. This would result in more sludge being deposited on that hearth to increase the moisture back up to 35%. The percentage split has been calculated on the basis of a 1600° F. temperature on hearth No. 2.

As can be seen from FIG. 5, the lower the moisture the greater the percentage of sludge deposited onto hearth No. 1.

The above represents a typical sludge feed, i.e., having a moisture content such that the temperature of hearth No. 1 is lowered by increasing the deposition of the feed sludge to this hearth. However, it is a special attribute of the furnace design of the present application that it is capable of operating efficiently under extreme conditions in respect to sludges of varying moisture and calorific content.

In the first case, assume that the feed sludge is an extremely autogenous sludge, i.e., it has a very low moisture content (i.e., less than about 35%, for example) and a high calorific value. In this situation, the sludge would begin burning in hearth No. 1 and raise the temperature of hearth No. 0 above 1400° F. The control circuit would respond by adding more sludge to hearth No. 1 but in this case it would not have the desired cooling effect. Therefore, the control circuit must operate to carry out a control step which, when all of the sludge is being deposited onto hearth No. 1, causes the air valve on hearth No. 1, which is normally held closed, to open and the quantity of air admitted is controlled by the temperature of hearth No. 1. The nominal control temperature of hearth No. 1 will be approximately 1450° F. which will result in 1400° F. at hearth No. 0.

The other extreme case is a sludge which has a high moisture content and low calorific value, commonly referred to as a non-autogenous sludge. When this type of sludge is fed to the furnace, the control circuit will begin to cause the following actions:

1. More and more, and eventually substantially all, of the sludge will be deposited onto hearth No. 2 as the system tries to react so as to reduce the amount of moisture and resulting cooling in the uppermost sludge handling hearth. If all of the sludge is being deposited onto hearth No. 2, and hearth No. 0 is still below 1400° F., the burner is activated on hearth No. 4, the firing rate is controlled by the temperature of hearth No. 0 (afterburner), and the problem of insufficient heat to sustain combustion is solved. Even though the burner on hearth No. 4 is controlled by the temperature on hearth No. 0, excessive temperatures on hearth No. 4 are not a concern because the air supply to that hearth controls the temperature of hearth No. 4 to a maximum of about 1500° F.

2. Because the temperature in the first combustion hearth, and eventually the lower hearths, will decrease due to the moisture in the sludge, the air to the hearths will be decreased in an attempt to minimize the cooling effect which will result in raising the temperature of the hearth.

There is a certain minimum excess air needed in the furnace to ensure complete combustion of the sludge and for multiple hearth furnaces, this generally accepted excess value is 75% above the stoichiometric amount theoretically needed to support complete combustion. When measured at the exhaust of the afterburner this works out to be about 6% oxygen. As stated above, with the non-autogenous sludge, the air to the hearths will be reduced in an effort to increase temperature and this will cause the excess oxygen to drop below 6%.

Therefore, when burning a non-autogenous sludge it is necessary to add sufficient auxiliary fuel so that a temperature of 1400° F. can be maintained in the afterburner, and to add sufficient excess air so that a minimum of 75% excess air can be maintained.

By having an override on the air valve supplying air to hearth No. 7, (which admits more air when the excess air gets below 75%), which override is responsive to the oxygen sensed at the exit from the afterburner, the excess air problem is solved.

Figure 3:
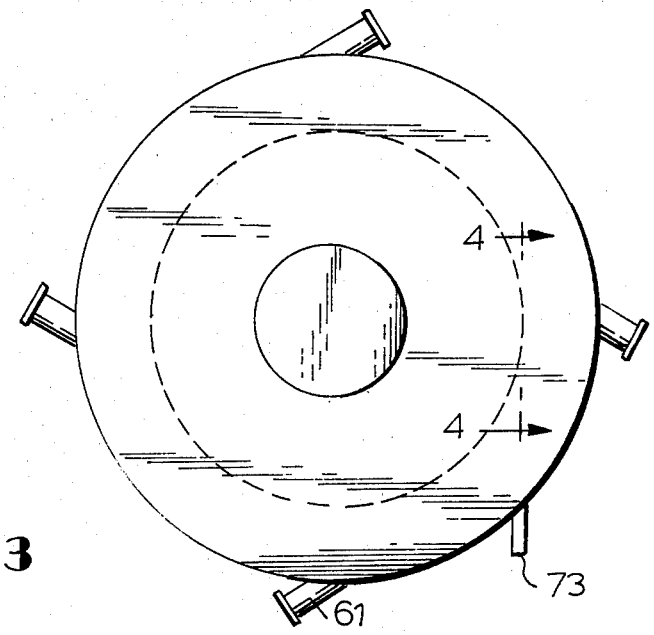
FIG. 3 is a schematic plan view taken along section lines 2—2 of FIG. 2.

There is another important modification of the present invention which serves to improve the overall performance of the method described above. This is the addition of high velocity mixing jets to increase turbulence as shown in FIG. 3 of the drawing. Before discussing the mode of operation of the air means described in FIG. 3, a general description of the air-mixing phenomenon in a conventional multiple hearth furnace will be described.

The gas velocity through a conventional multiple hearth incinerator is extremely slow, and at maximum feed rate the velocity in a radial, horizontal direction, at a point directly above the center of the hearth floor area is about 600 feet per minute. At lower feed rates, this velocity would be proportionally less. At these velocities, there is in sufficient turbulence to ensure complete combustion, and stratification of visible flames can be observed in conventional furnaces.

Referring to FIGS. 2 and 3 of the drawings, high velocity mixing air jets 73, are directed tangent to the imaginary circle that divides the horizontal cross-section area of the hearth furnace approximately in half, and initiates a cyclonic flow pattern. Main combustion air jets, interspaced between mixing air jets, are also directed tangent to this same circle and provide the bulk of the air needed for sludge combustion. The air flow rate to the high velocity mixing jets is kept constant to maintain this cyclonic flow, even when the incinerator is operated at less-than-maximum capacity. On the other hand, the air flow rate to the main combustion air jets is varied in accordance with the amount of air needed to control the hearth temperature.

The air jets are located in the upper part of the chamber of the individual hearth and situated so as to cause almost immediate mixing of the air with the combustion gases. Secondary or return flows, created by the swirling combustion gases, travel across the surface of the hearth, causing a flow of gases through and across the sludge furrows. Because the return flow is less turbulent, it will not kick up dust from the sludge on the various hearths and carry this undesirable particulate material into the atmosphere.

The existence of the cyclonic flow jets in the present invention and the particular design thereof have important ramifications in the operation of the furnace. Thus, since the turbulence produced by the cyclonic flow pattern is such as to cause almost immediate mixing of the gases, the thermocouples in the individual hearths sense the true condition of the hearths as opposed to a situation in which there is uneven mixing of the air and combustion gases, which according to the prior art methods, made it practically impossible to get an accurate picture of the true temperature conditions of the individual hearths.

There is also another advantage of the design of the cyclonic gas flow apparatus in that a small flow of air is introduced at high velocity in the smaller high velocity jets and the quantity of air is varied in the larger jets interspaced between said high velocity jets. This means that when operating under conditions in which non-autogenous sludge is substantially all deposited on feed hearth No. 2 in FIG. 1, or when autogenous sludge is fed at reduced feed rates, the air in the larger air supplying jets can be reduced without jeopardizing the necessary turbulence needed to effect rapid mixing of the gases. This makes it possible to get an accurate reading of the temperature conditions in the individual hearths, even under extreme conditions in which the total air supply must be decreased to increase the overall temperature.

It must be also emphasized that the cyclonic effect described above, has a provided higher combustion efficiency than conventional air supplying means used in multiple hearth furnaces. As a result of the higher burning rates promoted by the use of such cyclonic effect, coupled with positive and accurate control of the hearth temperature profile, the furnace size can be significantly reduced, resulting in a comparable reduction in capital cost. The ability to operate an autogenous sludge with additional grease and scum injection eliminates the expense of auxiliary fuel. Optimized potential for heat recovery offsets many of the operating costs. Where non-autogenous sludge must be burned, fuel usage is held to a minimum because the cyclonic flow allows reduced excess air operation.

While the drawings have shown that the main combustion jets are interspaced between the high velocity mixing jets and tangent to the same imaginary circle; nevertheless, it should be understood that the main combustion jets can be placed at any appropriate position in the hearths as long as the high velocity mixing jets are positioned so as to promote cyclonic flow in the manner described above.

It can be seen from the above that the present method represents a decided and significant improvement over the methods employed in conventional multiple hearth furnaces. According to the prior art methods, the multiple hearth furnaces were treated as a unitary thermal system, i.e., as a "black box" and it was not possible to get a true picture of the temperature conditions in the individual hearths and control of the temperatures in the individual hearths depended on the thermal conditions of the hearth of the hearth directly above and below the hearth being controlled. According to Applicant's invention, the individual hearths are treated as separate combustion chambers connected in series and each one is individually and accurately controlled as discussed above. Also, according to Applicant's invention it is now possible to control the temperature of the afterburner to those temperatures prescribed by environmental law without the need of auxiliary fuel.

It can be seen that the present method and furnace design offers great flexibility making it possible to incinerate sludge of varying water content and calorific value very efficiently and at great energy savings. The present method indeed represents a key advance over prior art methods.

DETAILED DESCRIPTION OF THE INVENTION

A specific apparatus for carrying out the various method aspects of the present invention as discussed above is shown schematically in FIGS. 2–4.

As seen particularly in FIG. 2, the multiple hearth furnace 10 is basically the same as the prior art multiple hearth furnaces, such as shown in U.S. Pat. No. 4,050,389 to von Dreusche, Jr.. It has a tubular outer shell 12 which is a steel shell lined with fire brick or other similar heat resistant material. The interior of the furnace 10 is divided by means of hearth floors 20 and 22 into plurality of vertically aligned hearths, the number of hearths being preselected depending upon the particular waste material being incinerated. Each of the hearth floors is made of a refractory material and is preferably slightly arched so as to be self supporting within the furnace. Outer peripheral drop holes 24 are provided near the outer shell at the outer periphery of the floors 22 and central drop holes 26 are provided near the center of the hearth floors 20. A rotatable vertical center shaft 28 extends axially through the furnace 10 and is supported in appropriate bearing means at the top and bottom of the furnace. This center drive shaft 28 is rotatably driven by an electric motor and gear drive generally indicated at 34. A plurality of spaced rabble arms 36 are mounted on the center shaft 28, and extend outwardly in each hearth over the hearth floor. The rabble arms have rabble teeth 40 formed thereon which extend downwardly nearly to the hearth floor. As the rabble arms 36 are carried around by the rotation of the center shaft 28, the rabble teeth 40 continuously rake through the material being processed on the respective hearth floors, and gradually urge the material toward the respective drop holes 24 and 26.

The lowermost hearth 58 is a hearth for collecting the ash, and cooling it, and, as indicated earlier, is called an ash cooling hearth.

An ash discharge 30 is provided in the bottom of the ash cooling hearth through which the ash remaining after combustion of the waste material is discharged from the furnace.

In the multiple hearth furnace according to the present invention, the uppermost hearth indicated at 42 serves as a so-called afterburner, i.e., a space in which the products of combustion are collected and the small quantity of combustible materials remaining therein burned. However, it should be understood that the afterburner can be constituted by a separate chamber, for example as shown schematically in U.S. Pat. No. 4,040,389, referred to above. In this case, the uppermost hearth 42 will then have a rabble arm 36 therein and will be the first hearth in which treatment of the waste material takes place.

The multiple hearth furnace of the present invention provides waste feed means 44 and 46, the waste feed means 44 supplying waste material to the second hearth down from the top, i.e., the hearth 48, and the waste feed means 46 supplies waste material to the third hearth down, i.e., the hearth 50. In this embodiment, the hearth 48 is the uppermost sludge handling hearth, and will hereinafter be referred to as the upper feed-drying hearth, and the hearth 50 as the lower feed-burning hearth. The remaining hearths below the lower feed-burning hearth 50 will simply be referred to as combustion hearths, leading ultimately into the ash cooling hearth.

An exhaust gas outlet 52 is provided in the afterburner hearth 42, and the bulk of the combustion air is supplied to the individual combustion hearths through air inlets 61 and the waste material to be incinerated is supplied through the supply means 44 and/or 46. The material is passed downwardly through the furnace in a generally serpentine fashion, i.e., alternately inwardly and outwardly across the hearths, while the combustion gases from the various hearths flow upward countercurrent to the downward flow of solid material. The gases flow upward in a serpentine or convoluted flow pattern through the openings 24 and 26 across the sludge or slurry on the hearths where the malodorous gases are treated in the afterburner at a nominal temperature to comply with environmental standards and ultimately all exhausted in an essentially unpolluted state.

An auxiliary fuel burner 56 is provided which burner is supplied with fuel through a valve 57. This burner serves initially to supply heat to the furnace for drying the initial charge of waste material and igniting it so as to begin combustion. Thereafter, once the furnace reaches a steady state, the fuel supply is cut-off, and the combustion becomes self-sustaining. It will of course be appreciated that fuel burners can be provided in more than one of the combustion hearths, and can be operated in tandem or in sequence as needed and can serve as the burner for supplying the initial heat. The burner 56 is illustrated at this location of the furnace only by way of illustration. At least one of the burners, however, is preferably located at at least one hearth below the lower feed-burning hearth as mentioned previously in respect to the description of Applicant's method and which will subsequently be pointed out in regard to this specific embodiment.

During normal operation, the burner 56 is controlled by controller 56*a* which is connected to the thermocouple 68 in the afterburner 42 and which responds to the temperature therein to cause the burner to operate when needed.

In the multi-hearth furnace of the present invention, the lower feed-burning hearth and each of the combustion hearths therebelow down to the combustion hearth next above the ash-cooling hearth is provided with a thermocouple 59 connected to a controller 60. It is further provided with an air inlet 61 controlled by an air inlet valve 62, to which the controller 60 is connected for control of the valve 62, in a manner to be described hereinafter. Each of the air inlet valves 62 is connected to a source 63 of low pressure air. The ash cooling hearth is also provided with a similar thermocouple 59, air inlet 61, and a control valve 62*a*. The air inlet 61 in the ash-cooling hearth is controlled by the valve 62*a* which in turn is connected to the source of low pressure air.

The upper feed-drying hearth also has an air inlet 61, which is controlled by a valve 64, which in turn is also connected to the source of low pressure air. The valve is controlled by a controller 60*a* which responds to a thermocouple 59 in the hearth 48.

The waste material supply means 44 and 46, in the present case the means for feeding sludge to the multi-hearth furnace, are supplied through a sludge feed divider 66 which receives the sludge or other waste material to be treated in the furnace. The sludge feed divider 66 is controlled by a sludge feed control 67 which in turn operates in response to the temperature sensed by a thermocouple 68 within the afterburner. The sludge feed divider 66 is merely a proportioning valve or the like which is driven to supply more sludge to the means 44 than the means 46 when the temperature sensed by the sludge feed control is rising, and which feeds more sludge to the means 46 if the temperature sensed by the temperature sensor 68 is falling. The sludge feed control 67 responds to the thermocouple 68 to supply a signal to the sludge feed divider 66 for driving it in this fashion. The sludge feed divider and sludge feed control are conventional devices which are readily available, and accordingly they need not be described further.

The sludge feed divider has means, such as a relay, to supply a signal when the sludge feed divider has reached a condition in which it is supplying all of the sludge to the means 44. The output from this signal producing means, which can be, for example, a relay, is supplied to an air add control means 69, which operates to close a normally open circuit from controller 60*a* to valve 64 to permit the air valve 64 to supply air to the air inlet 61 to the upper feed-burning hearth in response to the temperature therein. Likewise, the sludge feed divider 66 has means for producing a signal when the sludge feed divider is feeding all the sludge to the means 46. This output is supplied to a heat add control means 70 which in turn closes a normally open circuit from controller 56*a* to valve 57 to permit the operation of the valve 57 so as to supply fuel to the burner 56. This means 70 can, the same as means 69, be constituted by a relay means. It is the burner 56 mentioned above which must be located at least one hearth below the lower feed-burning hearth.

In the exhaust 52 from the afterburner 42 is an oxygen sensor 71, which includes means for producing a signal when the oxygen which is sensed in the exhaust gas outflow falls below a predetermined minimum. This means can be a relay means. This supplies a signal to an air supply control 72 which in turn overrides the control exercised on valve 62*a* by controller 60 for the ash-cooling hearth to further open the valve 62*a* to supply additional air to the air inlet 61 in the ash-cooling hearth.

The upper feed-drying and lower feed-burning hearths and each of the combustion hearths have, in addition to the air inlet 61, mixing air jets 73. As is seen in FIG. 2, these jets are positioned in the upper position of the respective combustion chambers. As seen in FIG. 3, these jets are directed tangentially to an imaginary circle which divides a horizontal plane through the combustion chamber into two approximately equal areas. Preferably the air inlets 61 are also directed tangentially to the same circle. These jets 73 are supplied with high pressure air from a source of high pressure air 74 controlled by a valve 75.

In the normal operation of the apparatus of the present invention, after the apparatus is operating following the starting up sequence of operations, sludge which is fed to the sludge feed divider will be fed to the upper feed-drying and lower feed-burning hearths in a proportion depending upon the moisture content and the composition of the sludge. As a specific example, for a sludge having 70 percent volatile solids, 10,500 btu/lb. of volatile solids, and 56 percent moisture, approximately 58% of the sludge will be fed to the upper feed-drying hearth, and the remainder to the lower feed-burning hearth, as shown in FIG. 5. The material of the upper feed-drying hearth will be dried by the combustion gases flowing upwardly through the furnace, until it reaches a percent moisture at which it will burn, e.g., 35% moisture. The operation is such that at this point the material will be caused to fall into the lower feed-burning hearth 50, where it will start burning. The material will be progressively fed downwardly through the respective combustion hearths until it reaches the lowermost combustion hearth at which point it will be completely burned and the ash will be fed into the ash cooling hearth 58.

The air supplied to the lower feed-burning hearth, and to the respective combustion hearths will be controlled by the respective controllers 60 so as to keep the temperature in these hearths at the desired burning temperatures. Preferably, the lower feed-burning hearth and the combustion hearths just therebelow will be maintained at about 1600° F. and the hearths below that will be maintained at progressively lower temperatures so as to begin cooling the ash prior to its being fed into the ash cooling hearth. The lowermost combustion hearth is preferably kept at approximately 700° F. so that when the ash is fed into the cooling hearth, the combustion air flowing into the ash cooling hearth will cool it to approximately 550° F. as illustrated in FIG. 1. Should the temperature get too high in a combustion hearth or the ash cooling hearth, the controller responds by opening the valves 62 or **62*a*** further. A simple relay controller can be used for this purpose and since these controllers are well known in the art, they will not be described further.

It is pointed out that the control for each of the hearths is independent of the control of the other hearths. This is possible because of the provision of the mixing air jets 73.

In order to clearly understand the purpose and effect of these jets, the pattern of turbulence within the respective hearths must be understood, although this has been generally described in illustrating the method in respect to FIG. 1.

Figure 4:
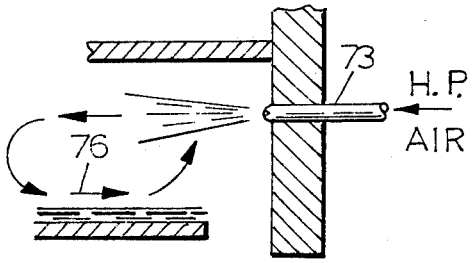
FIG. 4 is a partial sectional elevation view taken along line 3—3 of FIG. 3.

It has been found that in order to mix the combustion air and the products of combustion being driven off the waste material being treated, that the gases within the individual combustion hearths must circulate rather rapidly over the bed of waste material being incinerated. The mixing jets 73 are thus directed into the hearth near the top thereof and the secondary return flow indicated by the arrow 76 in FIG. 4 is used for sweeping over the bed of material in order to quickly mix the gases being driven off the waste material with the combustion air. This arrangement avoids unduly disturbing the bed of waste material while at the same time producing sufficient turbulence to promote immediate cooling and/or combustion.

The purpose of using the separate mixing air jets 73 is so that the needed energy for maintaining the necessary turbulence is supplied to the respective hearths regardless of the amount of combustion air being admitted. The jets are sufficiently small so that the quantity of combustion air being supplied to the hearth through the jets is insignificant as compared with the amount of air being admitted through the inlet 61. On the other hand, the flow of air through the inlet 61 is at a sufficiently low velocity so that the energy of the air is negligible as compared with the energy of the small mixing air jets coming through the nozzle 73. Thus, by maintaining the high pressure on the nozzle 73, high pressure mixing air jets with constant energy are directed into the hearths, while the quantity of combustion air is controlled by controlling the opening of the valve controlling the flow to the inlets 61. Thus, turbulence is maintained regardless of the amount of combustion air which is supplied for controlling the temperature. As an example, these high velocity mixing jets (typically a 1" pipe) with an outlet velocity of 10,000–20,000 feet per minute, are aimed tangent to an imaginary circle that divides the hearth floor area in half. The total quantity of air emitting from these jets is quite small (in the order of 5%–10% of the total air flow) but they do maintain turbulence, especially when the furnace is operating at less-than-maximum feed rates.

It can be seen from the above that the turbulence is maintained and the mixing is substantially complete within the individual combustion hearths, in spite of the fluctuating hearth air supply. As a result, the temperature sensing elements 59 sense the true conditions of combustion within the individual hearths, and by means of the controllers 60 responding to the temperature sensors 59, the desired temperature conditions can be maintained based directly on the sensing of the actual temperature conditions.

This is important for the overall control of the apparatus, as will be seen hereinafter.

The temperatures in the respective combustion hearths just below the lower feed-burning hearth are thus controlled to be at a maximum of 1600° F., as is the temperature in the lower feed-burning hearth 50. In the upper feed-drying hearth, the temperature is not controlled, but rather the temperature in the afterburner is sensed, which is essentially the temperature of the gases leaving the upper feed-drying hearth. This temperature will normally be 1400° F., if the proportion of the sludge fed to the upper feed-drying hearth is proper. Naturally, the amounts will vary depending upon the particular nature and moisture content of the sludge. As indicated above, for the particular sludge shown in FIG. 5, the percent feed according to the present moisture will produce the desired 1400° F. temperature in the afterburner.

If the temperature in the afterburner starts to increase, however, due to a change in the condition of the sludge, the sludge feed control causes the sludge feed divider to operate so as to supply more sludge to the upper feed-drying hearth 48. This will provide more moisture in the upper feed-drying hearth 48, which will tend to lower the temperature of the combustion gases flowing through this hearth, thereby reducing the temperature in the afterburner hearth. Should the temperature sensing means 68 sense a drop in the temperature, the control causes the sludge feed divider 66 to supply more sludge to the lower feed-burning hearth and reduce the amount of sludge to the upper feed-drying hearth 48, thereby reducing the amount of moisture and thereby causing an increase in the temperature in the afterburner.

It will thus be seen that the apparatus operates according to the first type of control according to the invention, i.e., the temperature in the afterburner is controlled by the division of the sludge feed, and also operates according to the second type of control, i.e., the control of the maximum temperature in the individual hearths is controlled by varying the quantity of the air supplied thereto. It will be seen that this latter aspect of the control can be accomplished because of the use of the tangentially directed nozzles 73 for supplying the mixing air jets, by which the temperature conditions within the individual hearths can be controlled in response solely to the temperature therein.

While the apparatus will normally operate in the above described mode, there will of course be times when, for one reason or another, the apparatus operates at extreme conditions outside the range shown in FIG. 5 and the waste material becomes rather dry, or very wet.

As described above, when the temperature in the after-burner 42 begins to rise, the sludge feed control 67 controls the sludge feed divider so as to feed a greater proportion of the sludge to the upper feed-drying hearth 48. When the sludge has a normal moisture content, this results in reducing the temperature of the gas due to evaporation of moisture into the gas, and the temperature in the afterburner hearth will fall. However, if the sludge is too dry, insufficient moisture will be evaporated in the upper feed-drying hearth 48 and the temperature will continue to rise. This will cause the sludge feed control 67 to control the sludge feed divider to feed still more sludge to the upper feed-drying hearth 48, until eventually all of the sludge is being fed to the upper feed-drying hearth 48, and practically no sludge is being fed to the lower feed-burning hearth. At this point, the temperature in the after-burner hearth will still not have been reduced, and accordingly, some measure must be taken to reduce this temperature.

This apparatus according to the present invention provides an air add control 69 connected to the sludge feed divider. The sludge feed divider has means, such as a relay, for producing a signal when it is operating to feed the majority or all of the sludge to the upper feed-drying hearth 48. This signal is supplied to the air add control 69, which in turn closes the circuit between controller 60*a* and the valve 64 controlling the air flow the air inlet 61 to the upper feed-drying hearth. The valve 64 is then operated in response to the temperature in hearth 48, so that additional air flows into the upper feed-drying hearth, thereby cooling the gases therein.

Should the other extreme condition occur, i.e., the sludge being fed to the sludge feed divider becomes very wet, this will add water to the system, and when it evaporates, it will cause the temperature in the afterburner hearth to fall. This causes the sludge feed control 67 to change the operation of the sludge feed divider 66 so as to feed more sludge to the lower feed-burning hearth 50 and less to the upper feed-drying hearth 48. However, because the amount of water added is so great, the evaporation of this water will continue to exert a cooling effect on the system, and the temperature in the afterburner hearth will continue to fall. Eventually, the sludge feed divider 66 will be feeding all of the sludge to the lower feed-burning hearth 50, and none to the upper feed-drying hearth. At this point, the continuation of the combustion of the material becomes endangered because of the large amount of water being fed to the system.

The sludge feed divider 66 has further means, such as an additional relay, to provide a signal when the sludge feed divider 66 is feeding all of the sludge to the lower feed-burning hearth 50. This signal is supplied to heat add control means 70, which in turn closes the circuit between controller 56*a* and the valve 57 controlling the supply of fuel to the fuel nozzle 56 in one of the lower combustion hearths. Thus, fuel is added to the system in response to the temperature in the afterburner to provide additional heat for overcoming the fall in temperature due to the evaporation of the large amounts of water being fed to the system in the sludge.

Also when burning a non-autogenous sludge, as described above, it is necessary to decrease the amount of excess air in the combustion hearths resulting in an increase of the temperature, as previously described. This may result in a deficiency of air in the system to complete combustion.

To compensate for the above, a control is built into the system which consists of an oxygen sensor means 71 provided in the exhaust gas outlet 52 from the afterburner 42, and this is set to provide a signal when the amount of oxygen in the exhaust gas falls below a predetermined amount such as excess necessary to ensure complete combustion. The signal thereby produced is supplied to an air supply control 72 which opens the valve 62*a* in the combustion air inlet 61 in the ash cooling hearth to provide more air above and beyond that needed to maintain the cooling hearth at a specified temperature, such as shown in FIG. 1, when the air in the combustion hearths fall below that necessary to support combustion as may be in the case when a non-autogenous sludge is burned. See the explanation of the method in respect to FIG. 1.

It will be understood that regardless of the fact that fuel is being burned in one of the combustion hearths below the lower feed-burning hearth, e.g., in the burning of non-autogenous sludge as described above, the temperature will never rise above a desired temperature in this hearth due to the presence of the controller 60 and air inlet control valve 62 for the individual hearths. Thus, there will be no overheating in the hearth where the fuel burner is provided.

It should be understood that high velocity mixing jets 73 may be provided in all hearths including the ash-cooling hearth, sludge-drying hearth, and afterburner, to ensure uniform mixing of the gases resulting in an accurate temperature reading of the true thermal conditions within the individual hearths. Also, while it has been pointed out that the maximum temperature of the combustion hearths should be controlled to about 1600° F., it must be understood that the disclosed method is capable of controlling the temperature of the afterburner and individual hearths to within any preselected temperature commensurate with the particular design constraints of the furnace construction. For existing designs the maximum operating temperature may be as high as about 1750° F.

Figure 6:
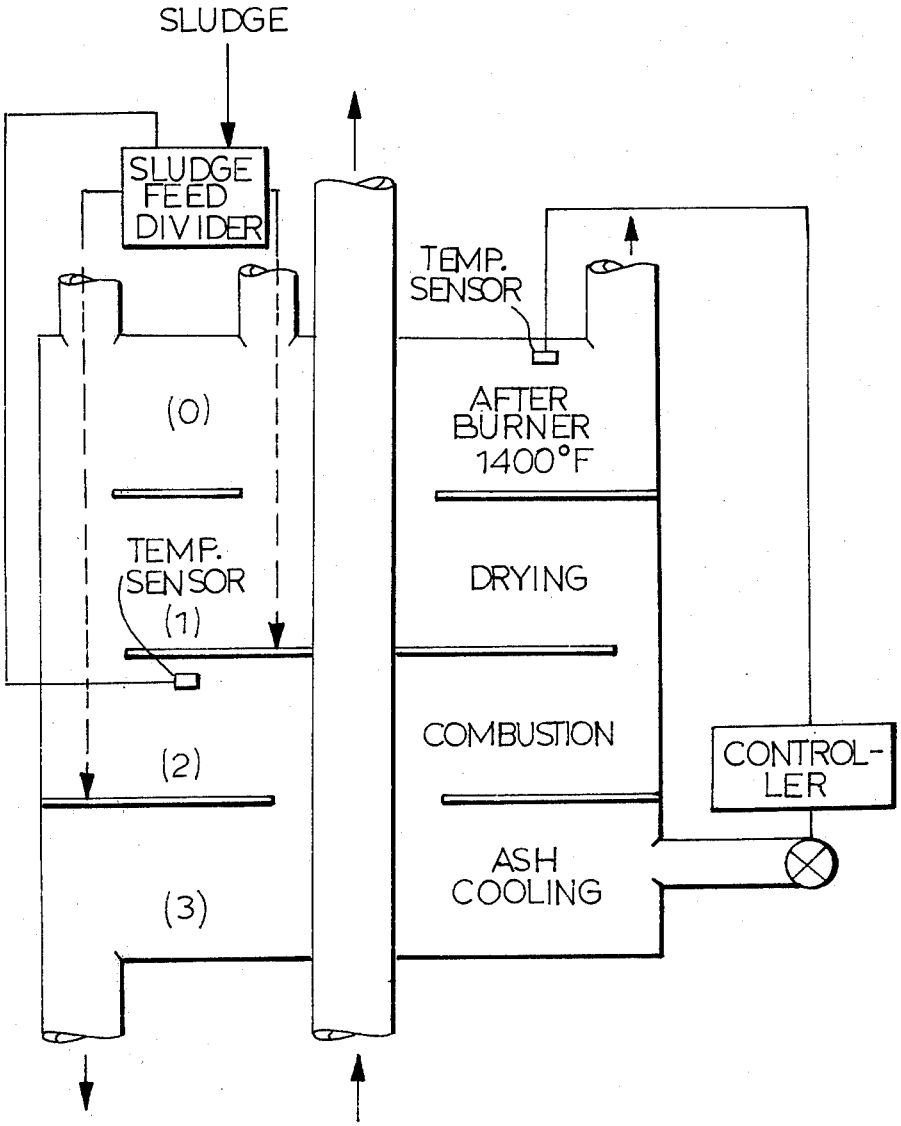
FIG. 6 is a schematic cross-section of a modified furnace.

It should also be understood that there are other variations of the present invention provided herein which may accomplish the same objectives of controlling the temperature of the afterburner, while at the same time preventing run away temperatures in the combustion hearth. In a simple four (4) hearth furnace such as shown in FIG. 6, the sludge may be divided between the drying hearth (1) and the combustion hearth (2), primarily for the purpose of controlling the temperature of the combustion hearth. In this case, the wet sludge deposited on hearth (2) acts as heat sink because of the wet sludge, which cools the temperature of the combustion hearth to within preselected limits. The percentage of sludge deposited on hearth (2) varies with the amount of moisture content, the amount of total feed, etc. In such an operation, the combustion air is typically supplied to the lower portion of the multiple hearth furnace as shown in FIG. 6. This operation is opposed to the conventional method in which all of the sludge is dried on the drying hearth (1).

To control the afterburner to within preselected limits in the case of such a four hearth multiple hearth furnace as described above, the temperature in the afterburner is prevented from getting too hot by adding excessive air thereto or if too low, auxiliary fuel may be added.

Finally, it must be emphasized that while the present invention has been described with reference to dewatered sludge, the method and apparatus can be used to treat combustible waste material generally, especially waste material containing water, such as water slurries of combustible waste material. Also, it must be pointed out that while the specific embodiments are illustrative of the practice of the invention, other expedients known to those skilled in the art may be employed to carry out Applicant's essential inventive concept without departing from the spirit of the invention or the scope of the claims.

What is claimed is:

1. In a method of incinerating combustible waste in a multiple hearth furnace containing a series of superimposed hearths which comprises feeding the combustible waste at the upper end of the furnace and passing the waste downward through a series of combustion hearths, supplying air to the combustion hearths to combust the waste material, and discharging the inert solid products of combustion at the lower end of the furnace, while the gaseous products of combustion flow upward countercurrent to the flow of waste material through the hearths and into an afterburner to remove the malodorous gases and/or pollutants, said afterburner being located after the uppermost waste handling hearth, the improvement wherein the temperatures of the afterburner and individual combustion hearths of the multiple hearth furnace are simultaneously controlled by:

(A) splitting the waste feed between (1) the uppermost waste handling hearth and (2) the hearth directly below the uppermost waste handling hearth in such proportions as to control the temperature of the afterburner to a temperature within preselected limits; and (B) controlling the supply of combustion air to the individual combustion hearths in sufficient quantities so as to operate the combustion hearths at a temperature at or below a preselected maximum temperature;

wherein said steps (A) and (B) are synchronized in response to the temperature of the afterburner and also in response to the temperatures in the individual combustion hearths by (I) controlling the temperature of the uppermost waste handling hearth below temperatures which would result in thermal stress of the furnace parts beyond safe operating limits and yet high enough to maintain the temperature of the afterburner within preselected limits to remove malodorous exhaust gases, and (II) controlling the temperatures of the combustion hearths by supplying air to the individual hearths in amounts sufficient to control the temperatures of said individual hearths at temperatures at or below preselected maximum temperatures, which temperatures are below that which would cause thermal stress in the furnace parts.

2. The method as claimed in claim 1 in which the after-burner temperature is controlled by varying the split of waste feed between the hearths (1) and (2) with the percentage of waste material supplied to the hearth (1) being increased as the temperatures in the afterburner are increased.

3. A method as claimed in claim 1 which comprises controlling the temperature of the afterburner to a nominal temperature of about 1400° F. and controlling the maximum combustion temperatures of the combustion hearths to about 1600° F.

4. The method as claimed in claims 1 or 2 in which the step of controlling the supply of combustion air to the individual hearths comprises directing high velocity jets of small amounts of air into the respective individual combustion hearths at constant air flow rates in amounts sufficient to create turbulence to ensure uniform mixing of the air and combustion gases so that the temperature measured in an individual hearth accurately represents the combustion conditions therein, and directing large cross-section low velocity streams of air from main air combustion jets in the respective individual combustion hearths for supplying the bulk of the combustion air to control the combustion in the hearths, said air flow rates from the main combustion jets being varied in accordance with the amount of air needed to control the temperatures in the individual hearths in response to the respective temperatures of the individual hearths.

5. The method as claimed in claim 4 which comprises directing the high velocity air jets tangent to an imaginary circle that divides the cross-sectional area of the annular hearth approximately in half and to initiate a cyclonic flow pattern.

6. The method as claimed in claim 5 which comprises interspacing the high velocity air jets between the low velocity streams introduced to supply the main combustion air to the individual combustion hearths and also directing the low velocity streams tangent to said imaginary circle.

7. The method as claimed in claims 1 or 2 which comprises incinerating autogenous sludge as the combustible material.

8. The method as claimed in claim 7 which comprises feeding substantially all of the sludge to hearth (1) in response to an increase in the temperature of the afterburner and supplying air to hearth (1) in amounts sufficient to cool the temperature of hearth (1) for reducing the temperature of the afterburner to within the preselected temperature range.

9. The method as claimed in claim 7 in which the step of controlling the supply of combustion air to the individual hearths comprises directing high velocity jets of small amounts of air into the respective individual combustion hearths at constant air flow rates in amounts sufficient to create turbulence to ensure uniform mixing of the air and combustion gases so that the temperature measured in an individual hearth accurately represents the combustion conditions therein and directing large cross-section low velocity streams of air from main air combustion jets into the respective individual combustion hearths for supplying the bulk of the combustion air to control combustion in the hearths, said air flow rates from the main combustion jets being varied in accordance with the amount of air needed to control the temperatures in the individual hearths in response to the respective temperatures of the individual hearths.

10. The method as claimed in claim 9 which comprises directing high velocity air jets are tangent to an imaginary circle that divides the cross-sectional area of the annular hearth approximately in half to initiate a cyclonic flow pattern.

11. The method as claimed in claim 10 which comprises interspacing high velocity air jets are between the low velocity streams introduced to supply the main combustion air to the individual combustion hearths and also directing the low velocity streams tangent to said imaginary circle.

12. The method as claimed in claim 1 which comprises incinerating nonautogenous sludge as the combustible material.

13. The method as claimed in claim 12, (i) which comprises feeding substantially all of the sludge to hearth (2) in response to a decrease in the temperature of the afterburner and (i) reducing the amount of air introduced into the combustion hearths to increase the temperatures thereof, (ii) igniting an auxiliary fuel burner located one or more hearths below the hearth (2) and (iii) sensing the oxygen content of the gases leaving the afterburner and when the oxygen content falls below an amount sufficient to ensure complete combustion of the sludge, introducing additional air through the bottom of the multiple hearth furnace.

14. The method as claimed in claim 13 in which the step of controlling the supply of combustion air to the individual hearths comprises directing high velocity jets of small amounts of air into the respective individual combustion hearths at constant air flow rates in amounts sufficient to create turbulence to ensure uniform mixing of the air and cumbustion gases so that the temperature measured in an individual hearth accurately represents the combustion conditions therein, and directing large cross-section low velocity streams of air from main air combustion jets into the respective individual combustion hearths for supplying the bulk of the combustion air to control the combustion in the hearths, said air flow rates from the main combustion jets being varied in accordance with the amount of air needed to control the temperatures of the individual hearths in response to the respective temperatures of the individual hearths.

15. The method as claimed in claim 14 comprises directing high velocity air jets tangent to an imaginary circle that divides the cross-sectional area of the annular hearth approximately in half initiate a cyclonic flow pattern.

16. The method as claimed in claim 15 which comprising interspacing high velocity air jets between the low velocity streams introduced to supply the main combustion air to the individual combustion hearths and also directing the low velocity streams tangent to said imaginary circle.

17. The method as claimed in claim 13 which comprises controlling the fuel flow in the auxiliary fuel burner in response to the afterburner temperature.

18. In a method of incinerating combustible waste in a multiple hearth furnace containing a series of superimposed hearths which comprises feeding the combustible waste at the upper end of the furnace and passing the waste downward through a series of combustion hearths, supplying air to the combustion hearths to combust the waste material and discharging the inert solid products of combustion at the lower end of the furnace, while the gaseous products of combustion flow upward countercurrent to the flow of waste material through the hearths and into an afterburner to remove the malodorous gases and/or pollutants, said afterburner being located after the uppermost waste handling hearth, the improvement comprising directing high velocity jets of small amounts of air into the respective individual combustion hearths at constant air flow rates in amounts sufficient to promote a cyclonic gas flow and create turbulence to ensure uniform mixing of the air and combustion gases so that the temperature in an individual hearth accurately represents the combustion conditions therein and directing large cross-section low velocity streams of air from main air combustion jets into the respective individual combustion hearths for supplying the bulk of the combustion air to control the combustion in the hearths, said air flow rates from the main combustion jets being varied in accordance with the amount of air needed to control the temperatures of the individual hearths in response to the respective temperature of the individual hearths.

19. The method as claimed in claim 18 which comprises directing the high velocity air jets tangent to an imaginary circle that divides the cross-sectional area of the annular hearth approximately in half to initiate a cyclonic flow pattern.

20. The method as claimed in claims 18 or 19 which comprises directing at least the high velocity jets are directed into the hearths near the top of the hearths, whereby the return flow sweeps over the bed of materials on the hearth with reduced turbulence for entraining emitted gases without kicking up dust from the bed of material.

21. The method as in claim 19 which comprises interspacing the high velocity air jets between the low velocity main combustion jets and directing the low velocity streams of air tangent to said imaginary circle.

22. The method according to claim 21 in which the air supply from the main combustion jets to the individual hearths is controlled in response to temperature sensor means located within each hearth, which temperature sensor means actuate air valves connected to each hearth to either increase or decrease the air supply, depending on the temperatures of the individual hearths.

23. The method of claim 18 in which high velocity jets supply about 5% to 10% of the total air supply to the individual jets.

* * * * *

UNITED STATES PATENT AND TRADEMARK OFFICE

CERTIFICATE OF CORRECTION

PATENT NO. : 4,391,208

DATED : July 5, 1983

INVENTOR(S) : Frederick M. Lewis

It is certified that error appears in the above-identified patent and that said Letters Patent are hereby corrected as shown below:

Cover page, column 2, "Manshansen" should read --Manshausen--.

Column 8, line 26, "in sufficient" should read --insufficient--.

Column 18, line 52, Claim 10, delete "are".

Column 18, line 57, Claim 11, delete "are".

Column 18, line 65, Claim 13, delete ", (i)".

Column 19, line 27, Claim 15, insert "which" before --comprises--; line 30, insert "to" before --initiate--.

Column 19, lines 32-33, Claim 16, "comprising" should read --comprises--.

Signed and Sealed this

Seventh Day of August 1984

[SEAL]

*Attest:*

*Attesting Officer*

GERALD J. MOSSINGHOFF

*Commissioner of Patents and Trademarks*